US010020609B2

(12) United States Patent
Matsumoto

(10) Patent No.: US 10,020,609 B2
(45) Date of Patent: Jul. 10, 2018

(54) CONNECTOR

(71) Applicant: YAZAKI CORPORATION, Tokyo (JP)

(72) Inventor: Yusuke Matsumoto, Shizuoka (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 15/815,591

(22) Filed: Nov. 16, 2017

(65) Prior Publication Data

US 2018/0138628 A1 May 17, 2018

(30) Foreign Application Priority Data

Nov. 17, 2016 (JP) ..... 2016-224215

(51) Int. Cl.

| | |
|---|---|
| ***H01R 13/62*** | (2006.01) |
| ***H01R 13/514*** | (2006.01) |
| ***H01R 13/64*** | (2006.01) |
| ***H01R 13/629*** | (2006.01) |
| *H01R 27/02* | (2006.01) |
| *H01R 13/641* | (2006.01) |

(52) U.S. Cl.

CPC ..... *H01R 13/514* (2013.01); *H01R 13/62938* (2013.01); *H01R 13/64* (2013.01); *H01R 13/62933* (2013.01); *H01R 13/641* (2013.01); *H01R 27/02* (2013.01)

(58) Field of Classification Search

CPC ..... H01R 13/514; H01R 13/62933; H01R 13/62938; H01R 13/641; Y10S 439/91

See application file for complete search history.

(56) References Cited

U.S. PATENT DOCUMENTS

| | | | | |
|---|---|---|---|---|
| 4,925,402 A * | 5/1990 | Inaba | H01R 13/641 | 439/490 |
| 5,425,653 A * | 6/1995 | Koiso | H01R 13/6272 | 439/347 |
| 5,507,665 A * | 4/1996 | Oda | H01R 13/641 | 439/357 |
| 6,568,954 B2 * | 5/2003 | Endo | H01R 13/641 | 439/352 |

(Continued)

FOREIGN PATENT DOCUMENTS

JP 2013-16316 A 1/2013

*Primary Examiner* — Tho D Ta
(74) *Attorney, Agent, or Firm* — Kenealy Vaidya LLP

(57) ABSTRACT

A connector includes a first connector portion, a second connector portion having housing members that are joined and fitted to the first connector portion, spacers inserted into the housing members from one side to retain terminals inside the housing members. The housing members each includes a joining surface at which the housing members are joined and an engaging rail formed on the joining surface. The engaging rails restrict a relative movement of the joined housing members in a separating direction with the engaging rails being engaged by inserting the engaging rails to each other along their longitudinal direction. The housing members each has an exposure hole on the other side surface. The exposure holes are located on a straight line perpendicular to the joining surfaces. The spacers are different in color from the housing members, and each has a projection to be exposed from the corresponding exposure hole.

3 Claims, 18 Drawing Sheets

(56) References Cited

U.S. PATENT DOCUMENTS

| | | | | |
|---|---|---|---|---|
| 7,044,758 | B2 * | 5/2006 | Deno | H01R 13/62955 439/157 |
| 7,329,132 | B1 * | 2/2008 | Kamath | H01R 13/193 439/157 |
| 2014/0113476 | A1 | 4/2014 | Shimizu et al. | |

* cited by examiner

CONNECTOR

CROSS-REFERENCE TO RELATED APPLICATION

The present application claims priority from Japanese Patent Application No. 2016-224215 filed on Nov. 17, 2016, the entire content of which is incorporated herein by reference.

FIELD OF INVENTION

The present invention relates to a connector.

RELATED ART

A related art connector includes a plurality of (e.g., two) housing members that are to be joined to each other (see, e.g., JP2013-16316A). In a connector of this kind, as shown in FIGS. 15 and 16, engaging rails 507, 509 extending in the thickness directions of housing members 501, 503 are formed on joining surfaces 505 of the housing members 501, 503, respectively. For example, the engaging rails 507, 509 are configured as dovetail tenons and dovetails. The engaging rails 507, 509 are inserted to each other along their longitudinal direction from an end of the engaging rail 507 on one side and from an end of the other engaging rail 509 on the other side, and are slid relative to each other along the longitudinal direction, whereby the housing members 501, 503 are joined to each other so as to be immovable in a direction away from each other.

As shown in FIGS. 16 and 17, the housing members 501, 503 that are joined to each other are fixed to each other with locks 511, 513 disposed in the joining surfaces 505 being engaged with each other to restrict sliding. The housing members 501, 503 that are joined to each other are temporarily fitted to a frame 515 that is shown in FIG. 18, and that houses a housing member (not shown) of a counter connector (not shown). A lever 517 is disposed in the frame 515. When an operating portion 523 is press-operated in a state where a cam follower 519 of the housing member 503 is inserted into a cam groove 521, the lever 517 is rotated, and the housing members 501, 503 and the counter connector are set into a properly fitted state by means of the lever function.

The joint positioning of the housing members 501, 503 is performed, using the engaging rails 507, 509 as match marks. However, since the engaging rails 507, 509 have a complicated shape, it is difficult to perform the positioning. In a surface where the one engaging rail 507 cannot be observed because of a stopper wall 525, it is more difficult to mutually position the engaging rails 507, 509, and therefore the joining work is performed while turning the housing members upside down. For these reasons, the related art connector having the conventional joining structure has a problem in that the joining work is poor in workability.

SUMMARY

Illustrative aspects of the present invention provide a connector in which a work for joining a plurality of housing members together is improved.

According to an illustrative aspect of the invention, a connector includes a first connector portion, a second connector portion having at least a first housing member and a second housing member that are configured to be fitted to the first connector portion in a state in which the first housing member and the second housing member joined to each other, a first spacer configured to be inserted into the first housing member from a side surface of the first housing member to restrict a first terminal housed inside the first housing member from being pulled out, and a second spacer configured to be inserted into the second housing member from a side surface of the second housing member to restrict a second terminal housed inside the second housing member from being pulled out. The first housing member includes a first joining surface to which the second housing member is joined and a first engaging rail formed on the first joining surface. The second housing member includes a second joining surface to which the first housing member is joined and a second engaging rail formed on the second joining surface. The first engaging rail and the second engaging rail are configured restrict a relative movement of the first housing member and the second housing member in a direction away from each other when the first housing member and the second housing member are joined to each other with the first engaging rail and the second engaging rail being engaged with each other. The first engaging rail and the second engaging rail are configured to be insertable to each other, along a longitudinal direction of the first engaging rail and the second engaging rail, from an end of the first engaging rail on one side and from an end of the second engaging rail on another side to engage the first engaging rail and the second engaging rail with each other. The first housing member has a first exposure hole on another side surface of the first housing member. The second housing member has a second exposure hole on another side surface of the second housing member. The first exposure hole and the second exposure hole are located on a straight line perpendicular to the first joining surface and the second joining surface in the state in which the first housing member and the second housing member joined to each other. The first spacer is different in color from the first housing member and has a first projection to be exposed from the first exposure hole on the other side surface of the first housing member when the first spacer is attached to the first housing member. The second spacer is different in color from the second housing member and has a second projection to be exposed from the second exposure hole on the other side surface of the second housing member when the second spacer is attached to the second housing member.

Other aspects and advantages of the invention will be apparent from the following description, the drawings and the claims.

DETAILED DESCRIPTION

Hereinafter, an exemplary embodiment of the invention will be described with reference to the drawings.

Figure 1:
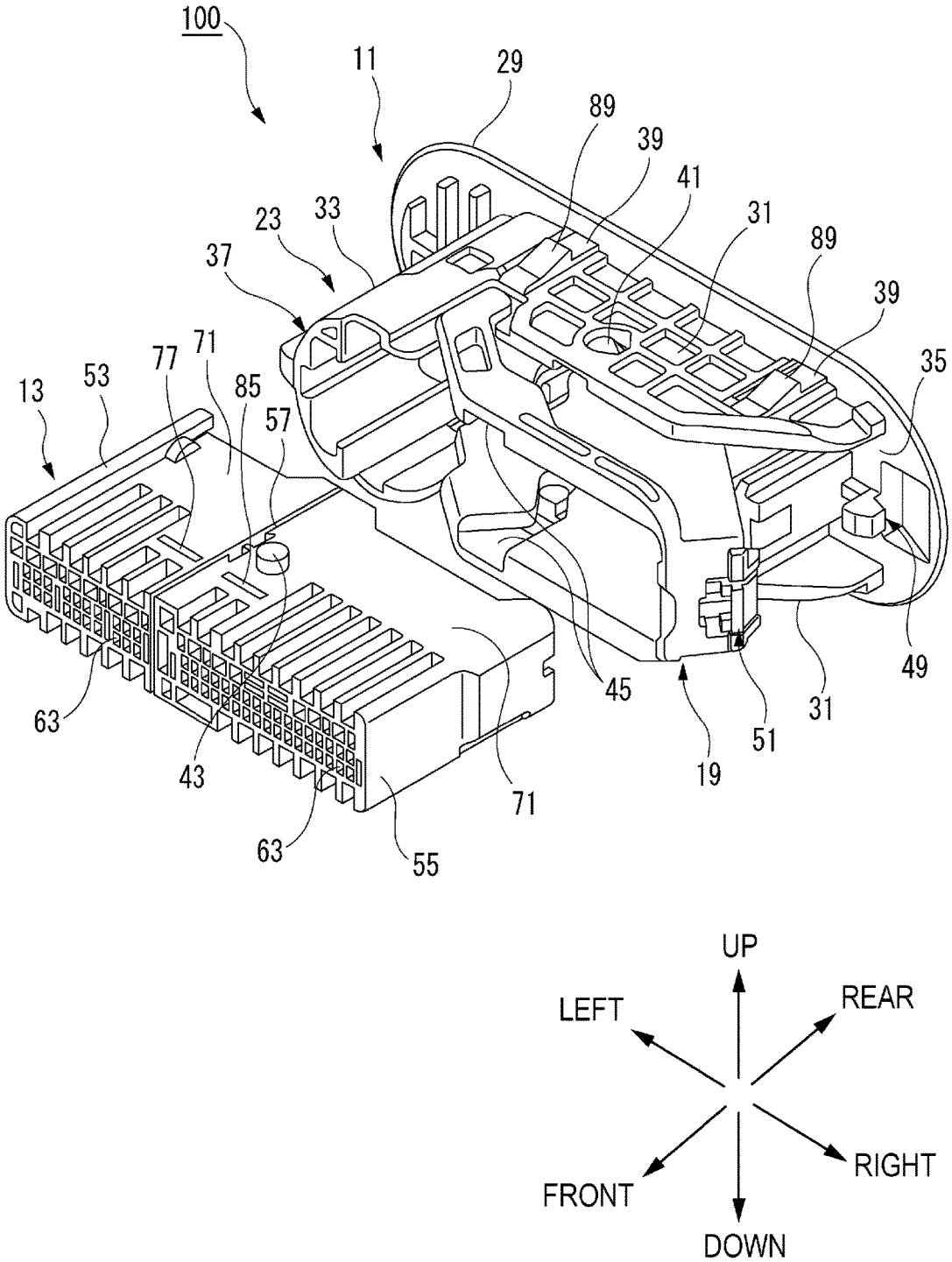
FIG. 1 is an exploded perspective view of a connector according to an exemplary embodiment of the present invention.

FIG. 1 is an exploded perspective view of a lever type connector 100 according to an exemplary embodiment of the present invention.

The lever type connector 100 is an example of a connector to which the present invention is applicable. A connector to which the present invention is applicable is not limited to a lever type connector. The lever type connector 100 has a first connector portion 11, a second connector portion 13, a lever 19, and spacers 69, 81 which are to be attached to the second connector portion 13. In the exemplary embodiment, the upper, lower, front, rear, right, and left directions are defined by the directions of the arrows shown in FIG. 1, respectively.

The lever type connector 100 is of a type in which the first connector portion 11 and the second connector portion 13 are previously fitted to each other in the outside of a panel 15 (see FIG. 13), the fitted connectors are fitted to a mounting hole 17 of the panel 15, and the connectors 11, 13 and the lever 19 are housed inside the panel 15.

Figure 2:
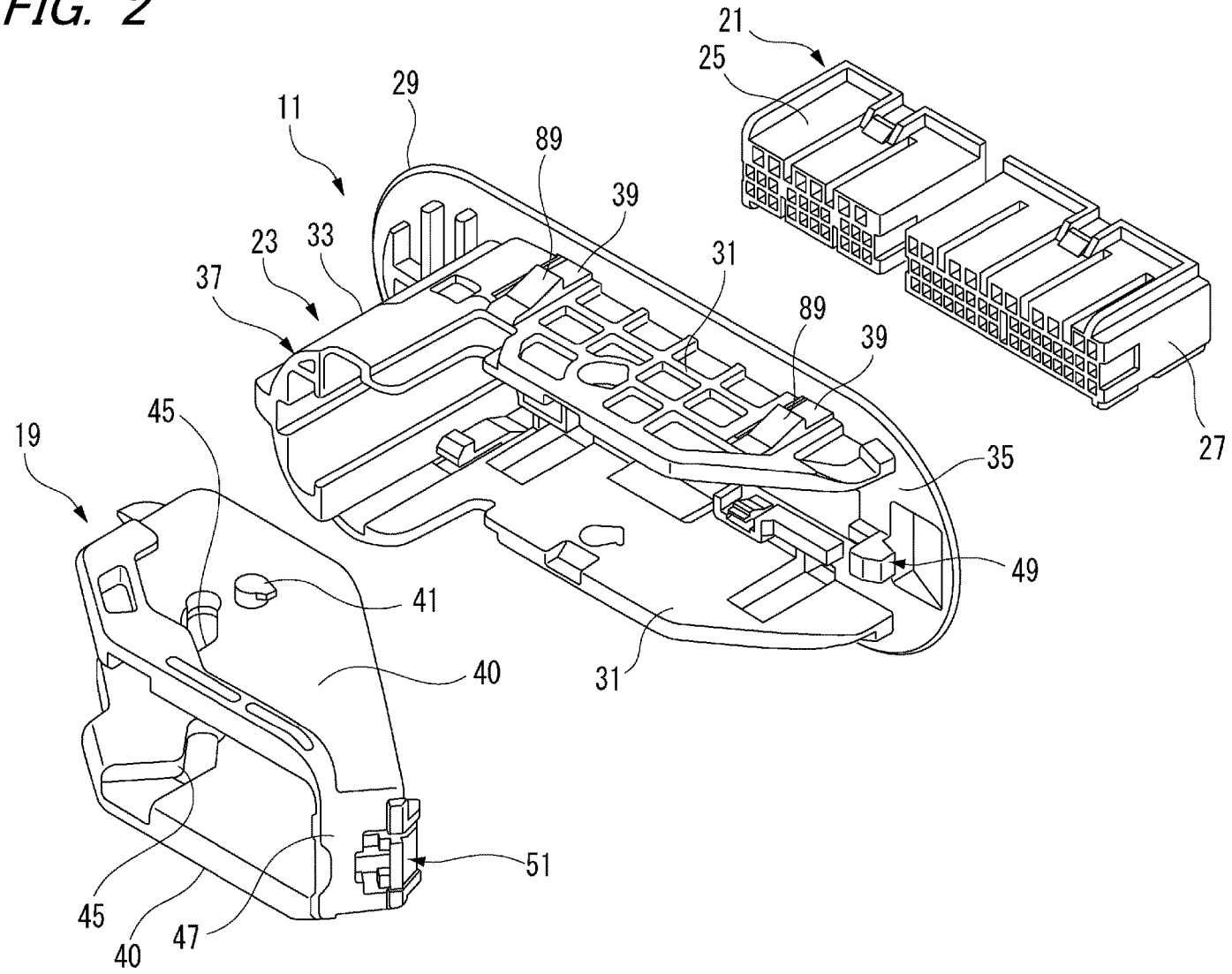
FIG. 2 is an exploded perspective view of the connector from which a second connector portion is omitted.

FIG. 2 is an exploded perspective view of the lever type connector 100 shown in FIG. 1 in which the second connector portion 13 is omitted.

The first connector portion 11 has an inner housing 21, a frame 23, and the lever 19. The inner housing 21 has a structure in which two inner housing members 25, 27 are laterally juxtaposed. A plurality of female terminals (not shown) are housed in the inner housing. The inner housing 21 is housed in the frame 23.

The frame 23 has a flange portion 29 having an elongated circular shape which is larger in size than the mounting hole 17 of the panel 15, and which is similar to the shape of the hole. A C-like peripheral wall 37 in which a pair of parallel side walls 31 are connected to each other by an arcuate wall 33, and their one sides are formed as an open portion 35 is erected on a surface of the flange portion 29 which is on the side (front side) to be inserted into the mounting hole. A pair of panel engagement locks 39 separated from each other in the longitudinal direction (lateral direction) of the elongated circular shape are formed on each of the paired side walls 31. That is, a total of four panel engagement locks 39 are disposed on the peripheral wall 37 of the frame 23.

The lever 19 is placed inside the first connector portion 11, and, when the lever is swung, causes the first connector portion 11 and the second connector portion 13 to be fitted to each other. The lever 19 is formed into a U-like shape in a plan view in which one ends of a pair of parallel side plates 40 of the lever are connected through an operating portion 47, and swingably incorporated into the frame 23 by pivoting portions 41 that are disposed on the both side surfaces, respectively. In a state where cam followers 43 of the second connector portion 13 are inserted into cam grooves 45, i.e., the first connector portion 11 and the second connector portion 13 are temporarily fitted to each other, the lever 19 is swung by press-operating the operating portion 47, to cause the first connector portion 11 and the second connector portion 13 to be set to a properly fitted state by means of the lever function. An engaging portion 51 which is to be engaged with an engaged portion 49 of the frame 23 is disposed in the lever 19.

Figure 3:
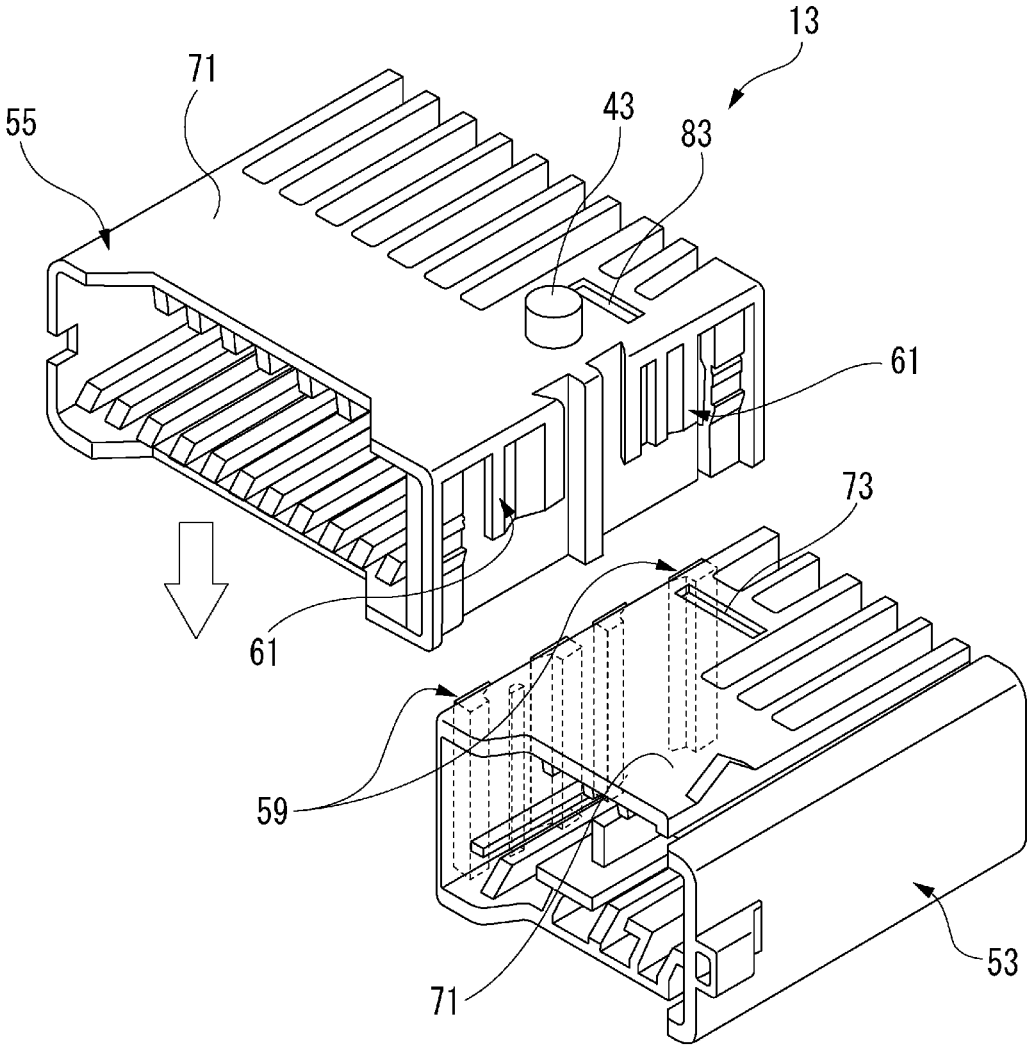
FIG. 3 is an exploded perspective view of the second connector portion.

FIG. 3 is an exploded perspective view of the second connector portion 13.

The second connector portion 13 has a structure in which two housing members 53, 55 that are larger than the inner housing 21 are joined to each other in the lateral direction. A plurality of male terminals (not shown) which are to be connected to the above-described female terminals are housed in the second connector portion. The cam followers 43 which are to be inserted into the cam grooves 45 of the lever 19 are projected from the side surfaces of the housing member 55, respectively. When the cam followers 43 are inserted into the cam grooves 45, and the lever 19 is swung, the second connector portion 13 is fitted into the inner housing 21, and the plurality of female terminals and the plurality of male terminals are collectively connected to each other.

Engaging rails 59, 61 extending in the vertical direction are formed on respective joining surfaces 57 of the housing members 53, 55. For example, the engaging rails 59, 61 are configured as dovetail tenons and dovetails. The engaging rails 59, 61 are inserted to each other along their longitudinal direction from an end of the engaging rail 59 on one side and from an end of the other engaging rail 61 on the other side, and are slid relative to each other in the longitudinal direction (vertical direction), whereby the housing members 53, 55 are joined to each other so as to be immovable in the direction (lateral direction) away from each other. In the following, the second connector portion 13 having the two housing members 53, 55 that are joined to each other is exemplarily described, but the number of the housing members to be joined to each other is not limited to two, and the present invention may be applied also to a structure in which three or more housing members are joined to each other.

Figure 4B:
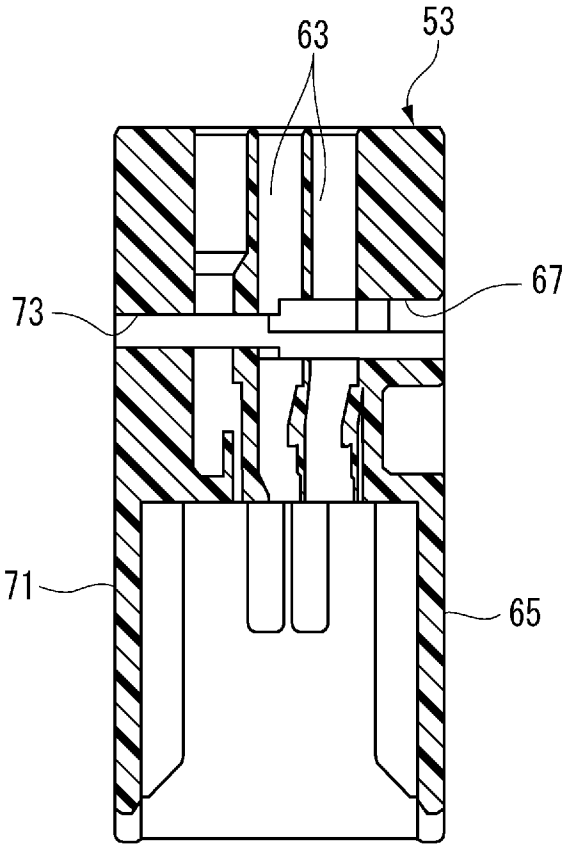
FIG. 4B is a sectional view taken along the line A-A of FIG. 4A.
Figure 4A:
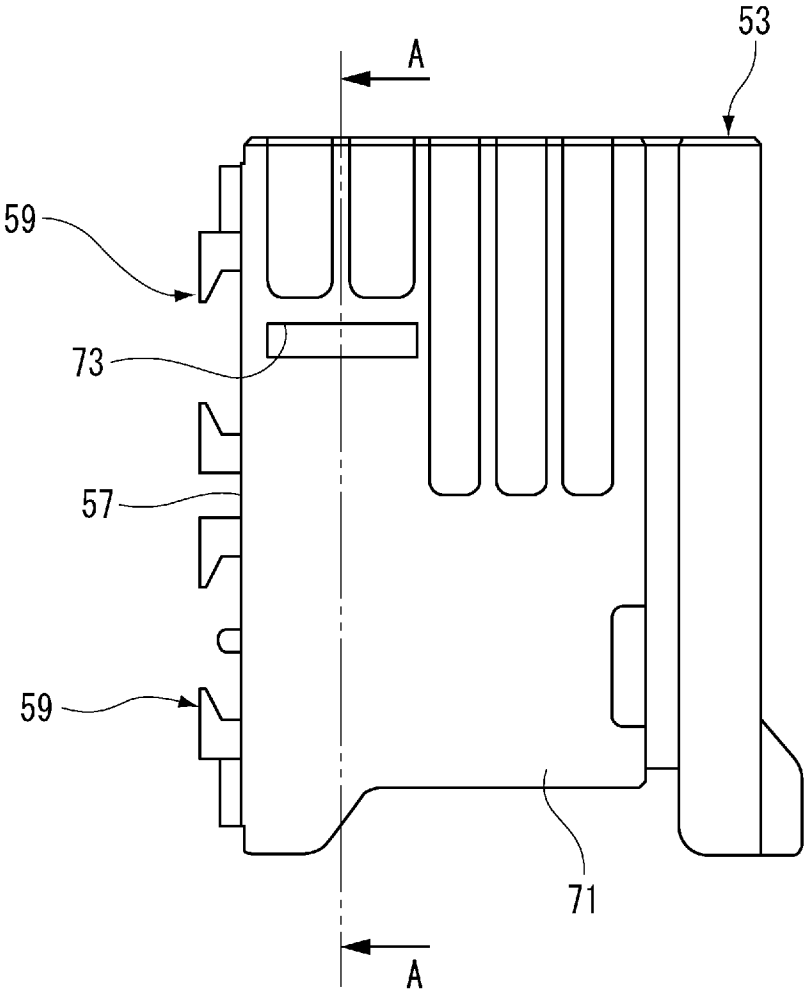
FIG. 4A is a plan view of one of housing members shown in FIG. 3.

FIG. 4A is a plan view of the one housing member 53, and FIG. 4B is a sectional view taken along the line A-A of FIG. 4A.

In the housing member 53, a plurality of terminal housing chambers 63 are formed so as to be juxtaposed in the vertical and lateral directions. A spacer attachment port 67 is opened in one side surface 65 of the housing member 53. The spacer attachment port 67 is formed over a substantially entire lateral width of the one side surface 65 of the housing member 53 (see FIG. 10). A spacer 69 is attached to the spacer attachment port 67. On the other hand, an exposure hole 73 is formed in the other side surface 71 of the housing member 53. The exposure hole 73 communicates with the spacer attachment port 67.

Figure 5A:
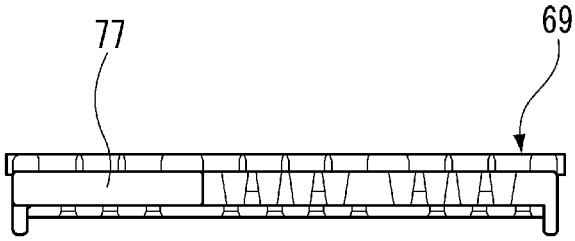
FIG. 5A is a plan view of a spacer to be attached to the housing member of FIGS. 4A and 4B.
Figure 5B:
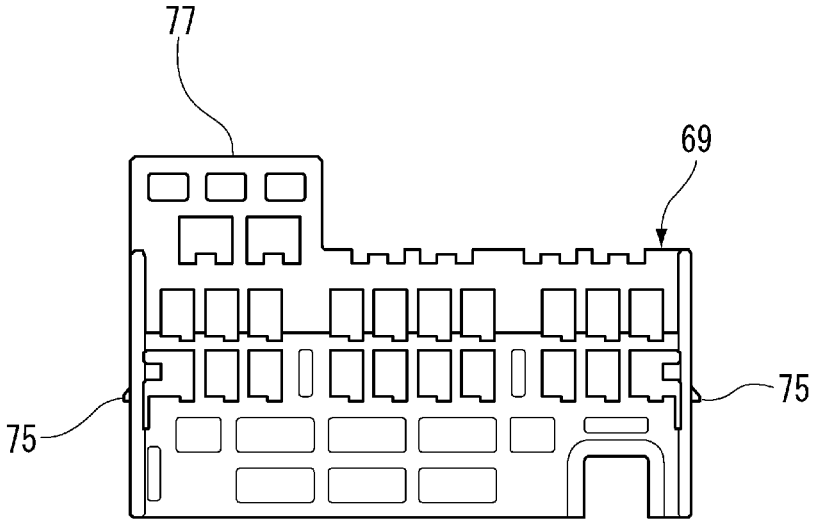
FIG. 5B is a front view of the spacer of FIG. 5A.

FIG. 5A is a plan view of the spacer 69 which is to be attached to the one housing member 53, and FIG. 5B is a front view of FIG. 5A.

The spacer 69 is has a planar shape that can be inserted into the spacer attachment port 67. The spacer 69 is attached to the housing member 53 by being inserted into the spacer attachment port 67, whereby the male terminals engaged with the terminal housing chambers 63 are doubly restricted from being pulled out. The spacer 69 has pacer claws 75 to be engaged with the housing member 53 to prevent separation. A projection 77 is projected from a tip end side of the spacer 69 in the insertion direction. The projection 77 is inserted into the exposure hole 73 which is opened in the other side surface 71 of the housing member 53. The projection 77 is placed so as to be approximately flush with the opening surface of the exposure hole 73. The spacer 69 is molded with a resin which is different in color from the housing member 53. Therefore, the projection 77 which is exposed through the exposure hole 73 has a high visibility.

Figure 6B:
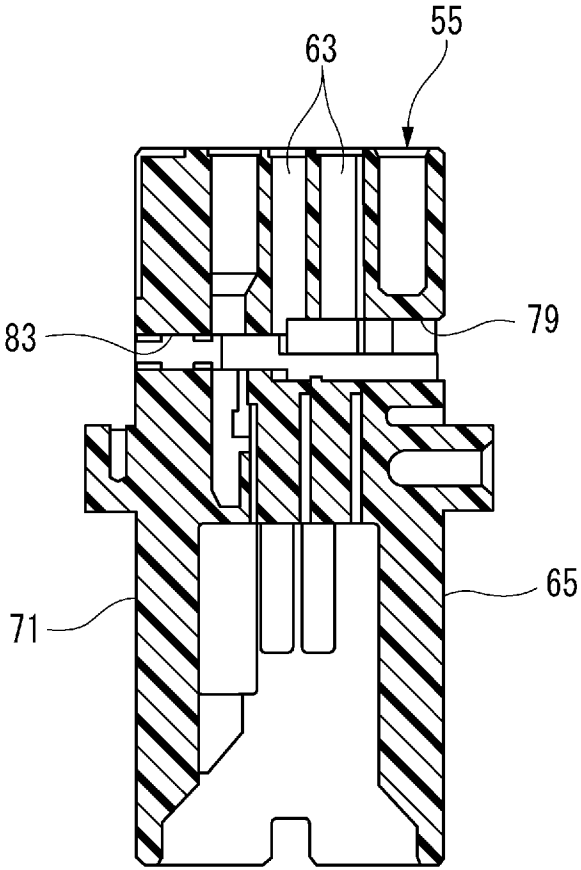
FIG. 6B is a sectional view taken along the line B-B of FIG. 6A.
Figure 6A:
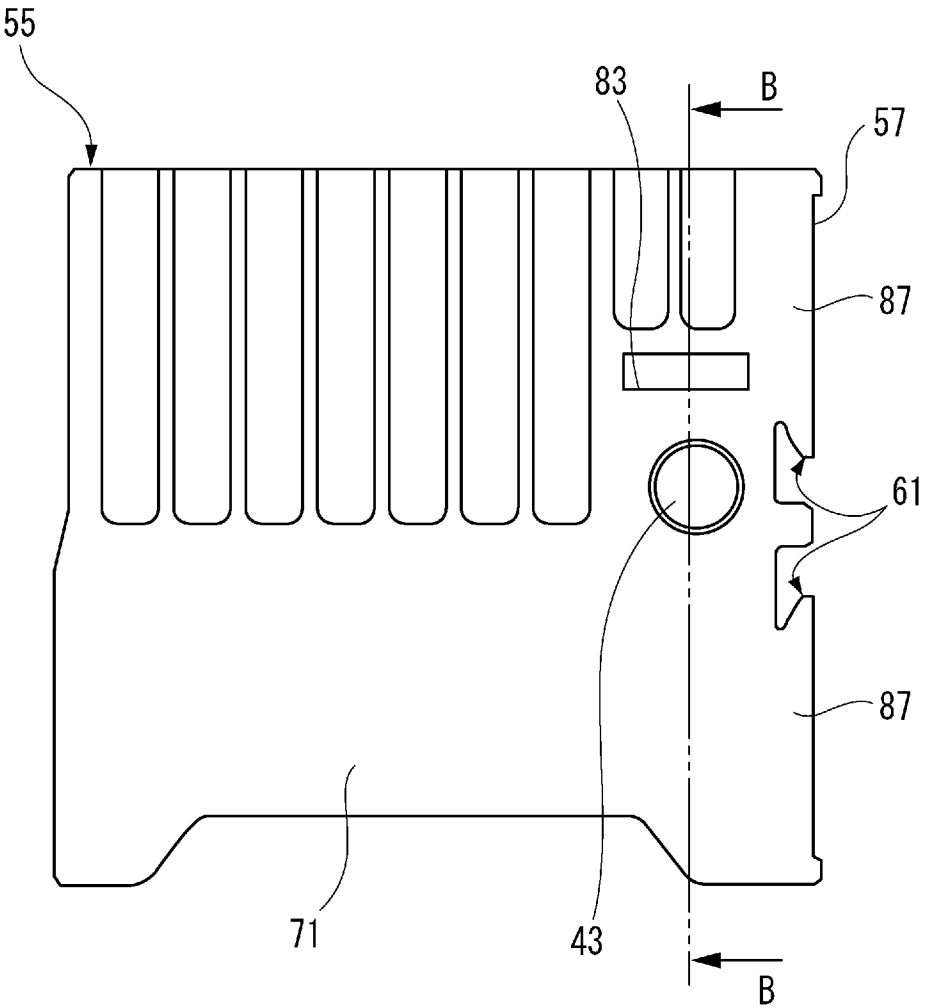
FIG. 6A is a plan view of the other housing member.

FIG. 6A is a plan view of the other housing member 55, and FIG. 6B is a sectional view taken along the line B-B of FIG. 6A.

In the housing member 55, a plurality of terminal housing chambers 63 are formed so as to be juxtaposed in the vertical and lateral directions. A spacer attachment port 79 is opened in one side surface 65 of the housing member 55. The spacer attachment port 79 is formed over a substantially entire lateral width of the one side surface 65 of the housing member 55 (see FIG. 10). A spacer 81 is attached to the spacer attachment port 79. On the other hand, an exposure hole 83 is formed in the other side surface 71 of the housing member 55. The exposure hole 83 communicates with the spacer attachment port 79.

Figure 7A:
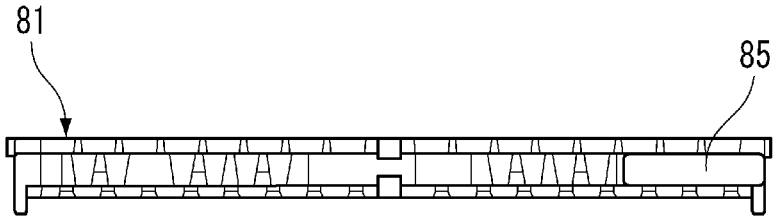
FIG. 7A is a plan view of a spacer be attached to the other housing member of FIG. 6A.
Figure 7B:
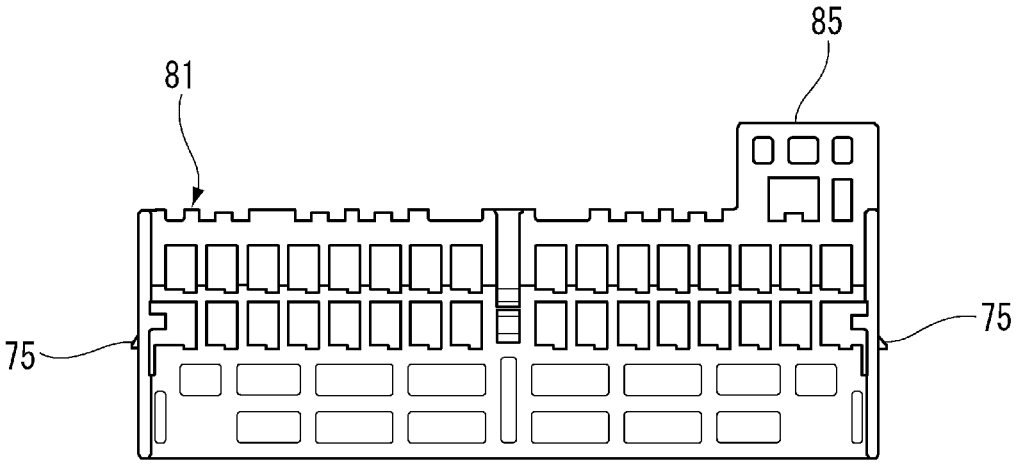
FIG. 7B is a front view of the spacer of FIG. 7A.

FIG. 7A is a plan view of a spacer 81 which is to be attached to the other housing member 55, and FIG. 7B is a front view of FIG. 7A.

The spacer 81 has a planar shape that can be inserted into the spacer attachment port 79. The spacer 81 is attached to the housing member 55 by being inserted into the spacer attachment port 79, whereby the male terminals engaged with the terminal housing chambers 63 are doubly restricted from being pulled out. The spacer 81 has spacer claws 75 to be engaged with the housing member 55 to prevent separation. A projection 85 is projected from a tip end side of the spacer 81 in the insertion direction. The projection 85 is inserted into the exposure hole 83 which is opened in the other side surface 71 of the housing member 55. The projection 85 is placed so as to be approximately flush with the opening surface of the exposure hole 83. The spacer 81 is molded with a resin which is different in color from the housing member 55. Therefore, the projection 85 which is exposed through the exposure hole 83 has a high visibility.

Figure 8B:
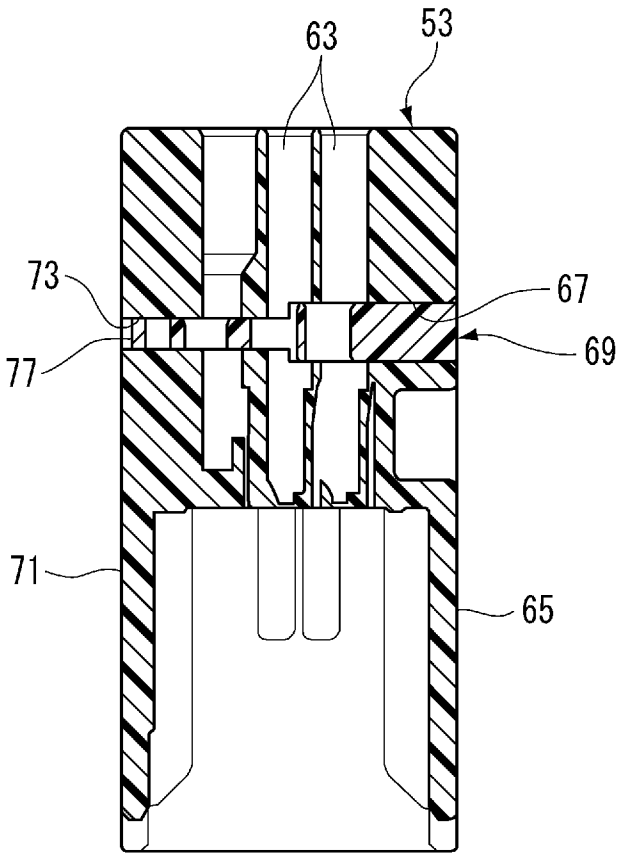
FIG. 8B is a sectional view taken along the line C-C of FIG. 8A.
Figure 8A:
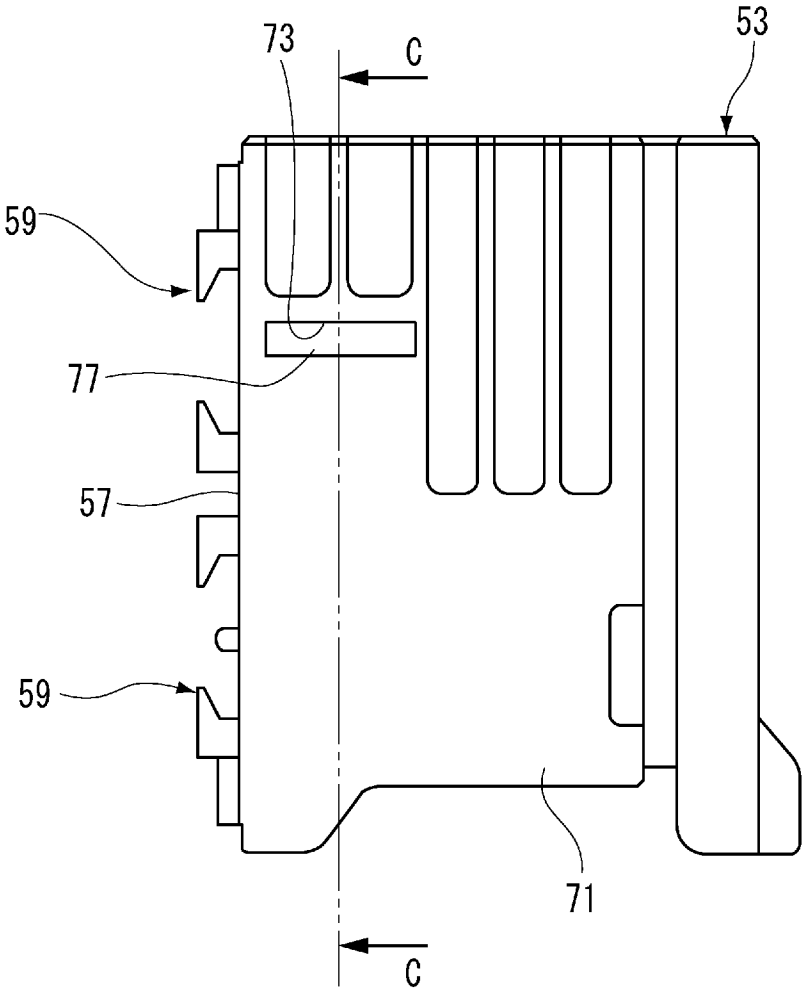
FIG. 8A is a plan view of the one housing member to which the spacer is attached.

FIG. 8A is a plan view of the one housing member 53 to which the spacer 69 is attached, and FIG. 8B is a sectional view taken along the line C-C of FIG. 8A.

When the spacer 69 is attached to the housing member 53, the projection 77 is exposed through the exposure hole 73. Here, the exposure hole 73 is located on a straight line which is perpendicular to the joining surface 57.

Figure 9B:
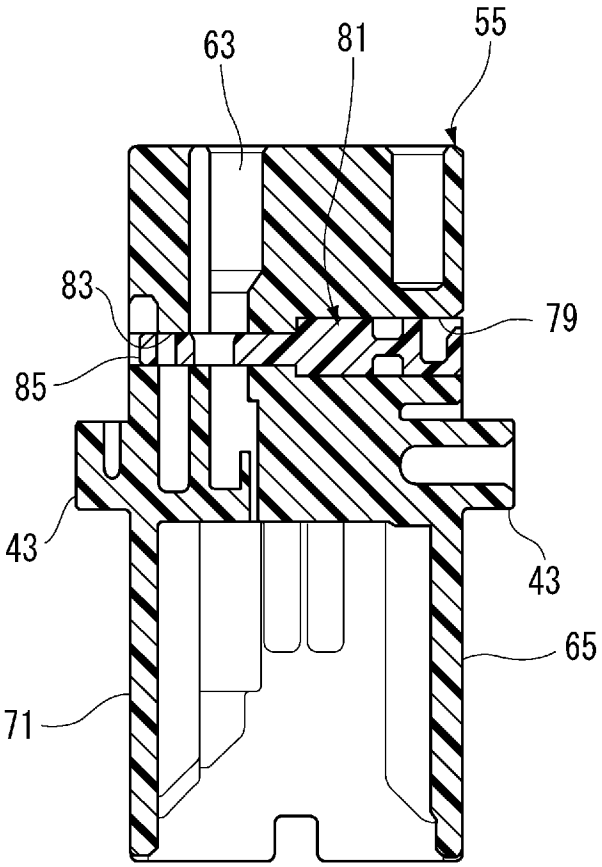
FIG. 9B is a sectional view taken along the line D-D of FIG. 9A.
Figure 9A:
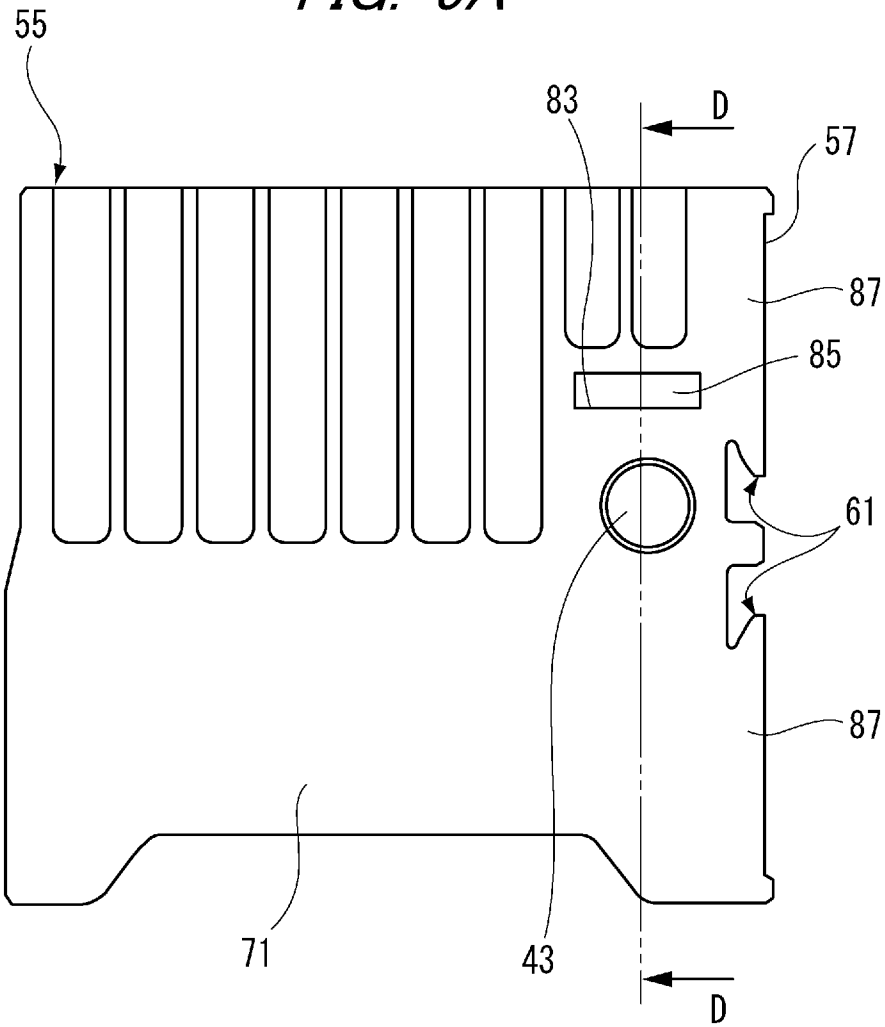
FIG. 9A is a plan view of the other housing member to which the spacer is attached.

FIG. 9A is a plan view of the other housing member 55 to which the spacer 81 is attached, and FIG. 9B is a sectional view taken along the line D-D of FIG. 9A.

When the spacer 81 is attached to the housing member 55, the projection 85 is exposed through the exposure hole 83. Here, the exposure hole 83 is located on a straight line which is perpendicular to the joining surface 57.

The exposure holes 73, 83 are placed on the same straight line in a state where the housing members 53, 55 are joined to each other. When the housing members 53, 55 are joined to each other, namely, the exposure holes 73, 83 and the projections 77, 85 are placed on the same straight line which is perpendicular to the joining surfaces 57 (see FIG. 12).

In the lever type connector 100, the exposure holes 73, 83 and the projections 77, 85 are linearly formed in the direction along the straight line which is perpendicular to the joining surfaces 57.

Next, the operation of the lever type connector 100 will be described.

Figure 10:
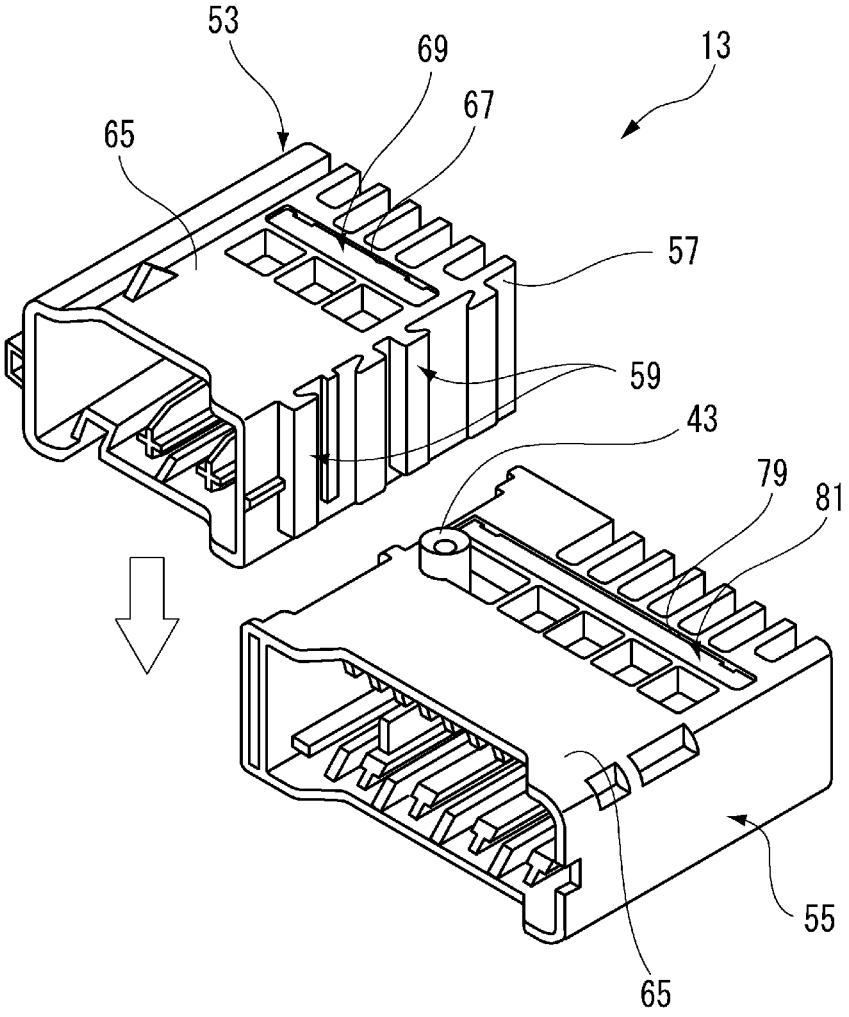
FIG. 10 is an exploded perspective view of the two housing members which have not yet been joined to each other, as seen from one side.

FIG. 10 is an exploded perspective view of the two housing members 53, 55 which have not yet been joined to each other, as seen from the side of the one side surfaces 65.

In the lever type connector 100, the spacers 69, 81 are attached to the housing members 53, 55 of the second connector portion 13 through the spacer attachment ports 67, 79 of the one side surfaces 65, respectively. The spacers 69, 81 attached respectively to the spacer attachment ports 67, 79 are placed on the same straight line perpendicular to the joining surfaces 57. In the housing members 53, 55, the both engaging rails 59, 61 can be seen as viewed from the side of the one side surfaces 65, and therefore the joining work can be satisfactorily performed.

Figure 11:
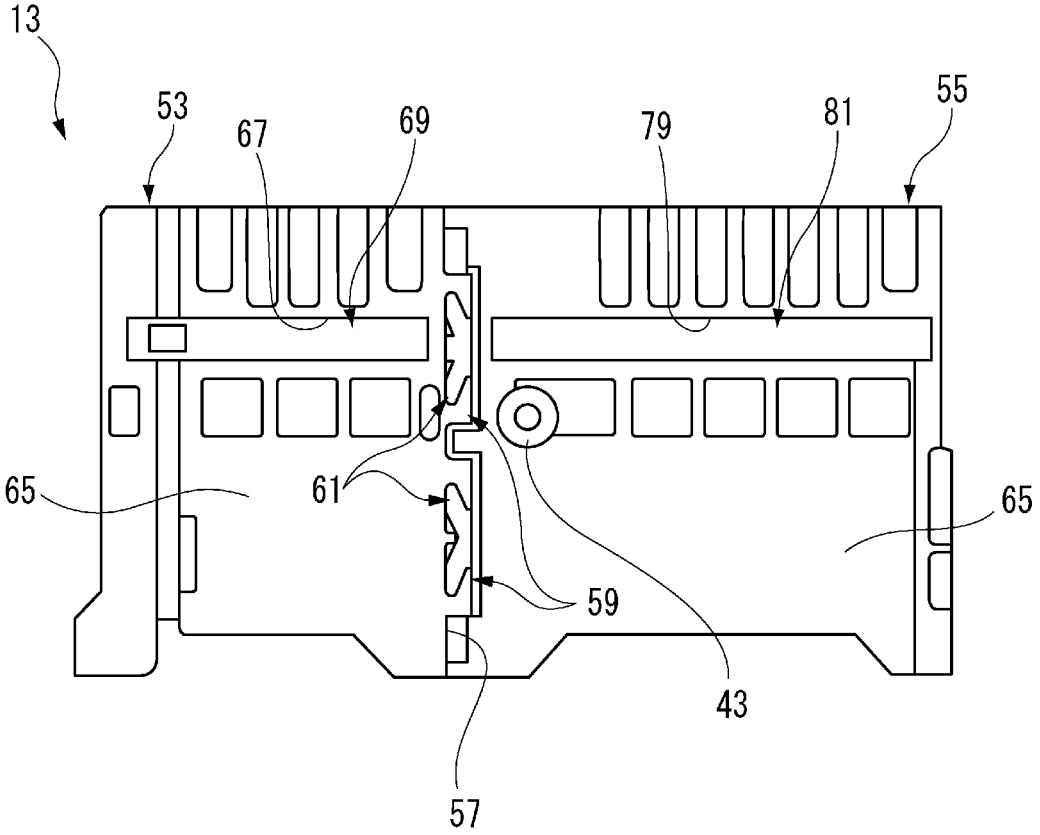
FIG. 11 is a plan view of the two housing members which are joined to each other, as seen from the one side.

FIG. 11 is a plan view of the two housing members 53, 55 which are joined to each other, as seen from the side of the one side surfaces 65.

The housing members 53, 55 are joined to each other by inserting the engaging rails 59, 61 into each other such that the lateral movement of the housing members 53, 55 is restricted. The restriction of the housing members 53, 55 in the sliding direction is performed by a stopper wall 87 (see FIG. 12) which is formed in the housing member 55.

Figure 12:
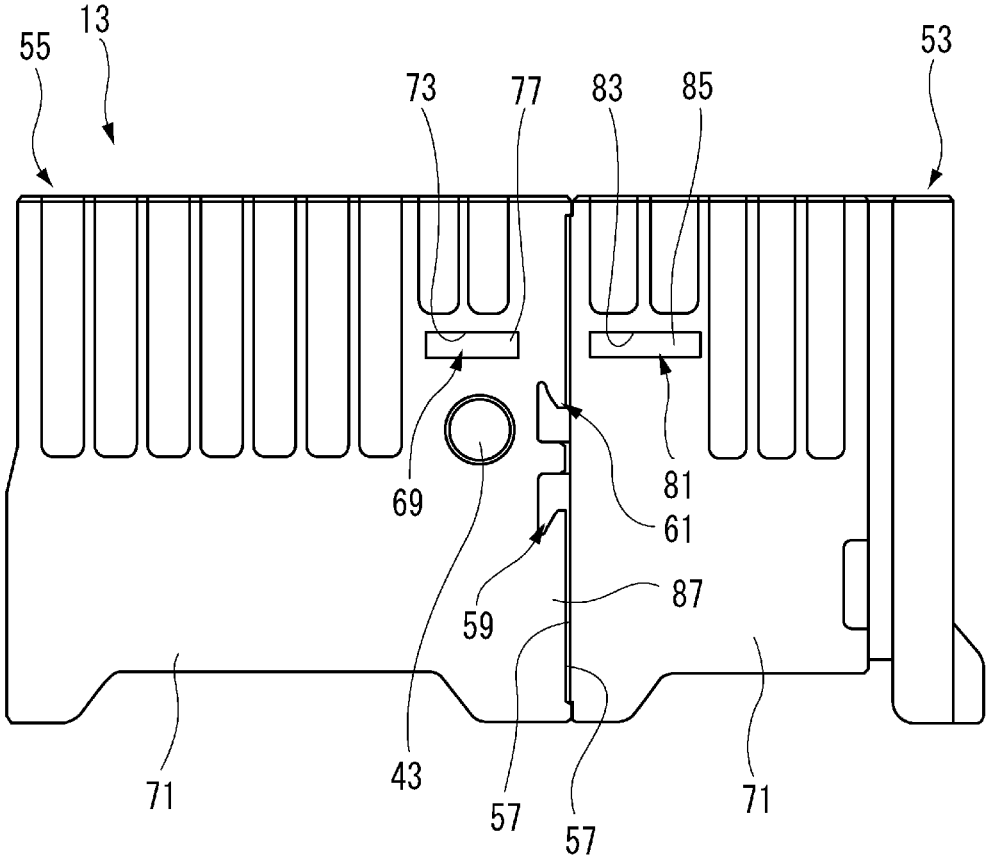
FIG. 12 is a plan view of the two housing members which are joined to each other, as seen from the other side.

FIG. 12 is a plan view of the two housing members 53, 55 which are joined to each other, as seen from the side of the other side surfaces 71.

When joining the housing members 53, 55 together while viewing the side of the other side surfaces 71, the exposed projections 77, 85 which are exposed through the exposure holes 73, 83 are aligned on one straight line. Although the engaging rails 61 of the housing member 55 are partly covered and hidden by the stopper wall 87, the positioning of the the exposed projections 77, 85 on the one straight line enables the engaging rails 59, 61 to be easily inserted to each other.

Figure 13:
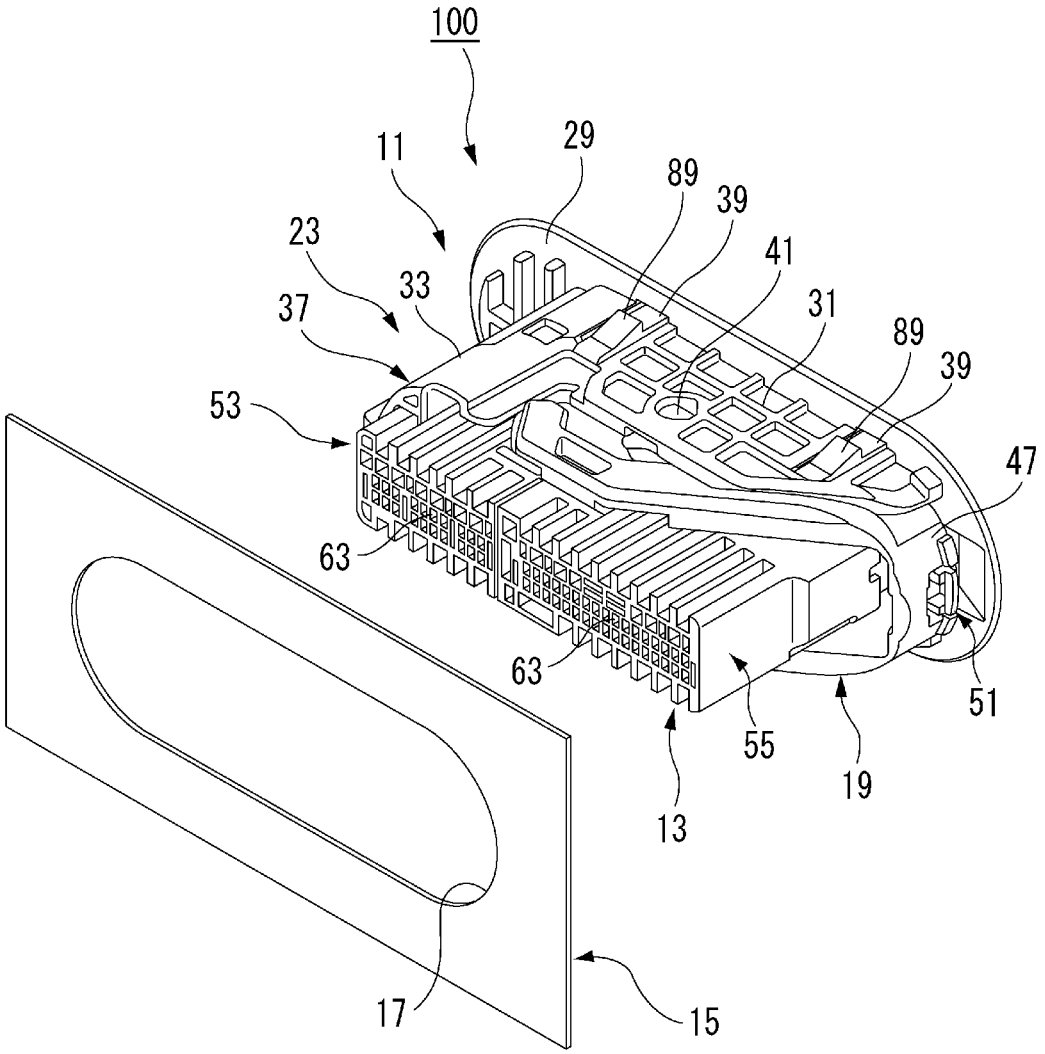
FIG. 13 is a perspective view of the connector which has not yet been attached to a panel.

FIG. 13 is a perspective view of the lever type connector 100 which has not yet been attached to the panel 15.

The second connector portion 13 configured by the housing members 53, 55 which are integrated with each other is inserted into the frame 23 in the temporarily fitted state. Then, the operating portion 47 of the lever 19 is press-operated to cause the first connector portion 11 and the second connector portion 13 to be set to the properly fitted state by means of the lever function.

Figure 14:
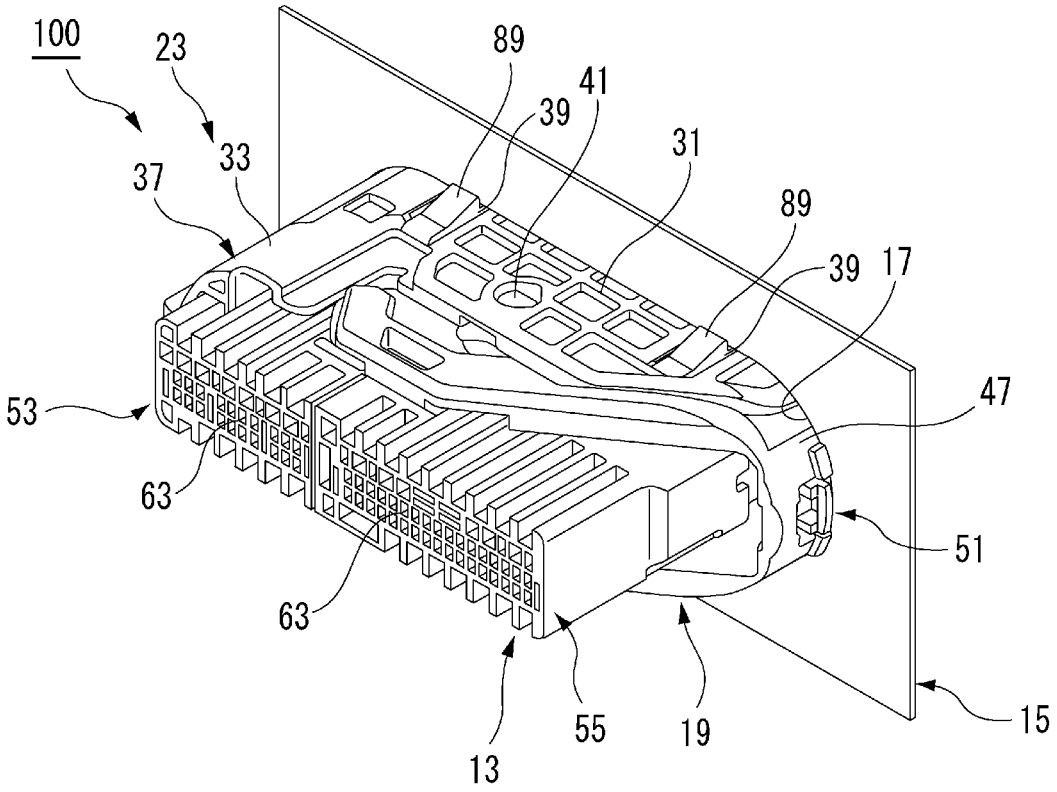
FIG. 14 is a perspective view of the connector attached to the panel.
Figure 15:
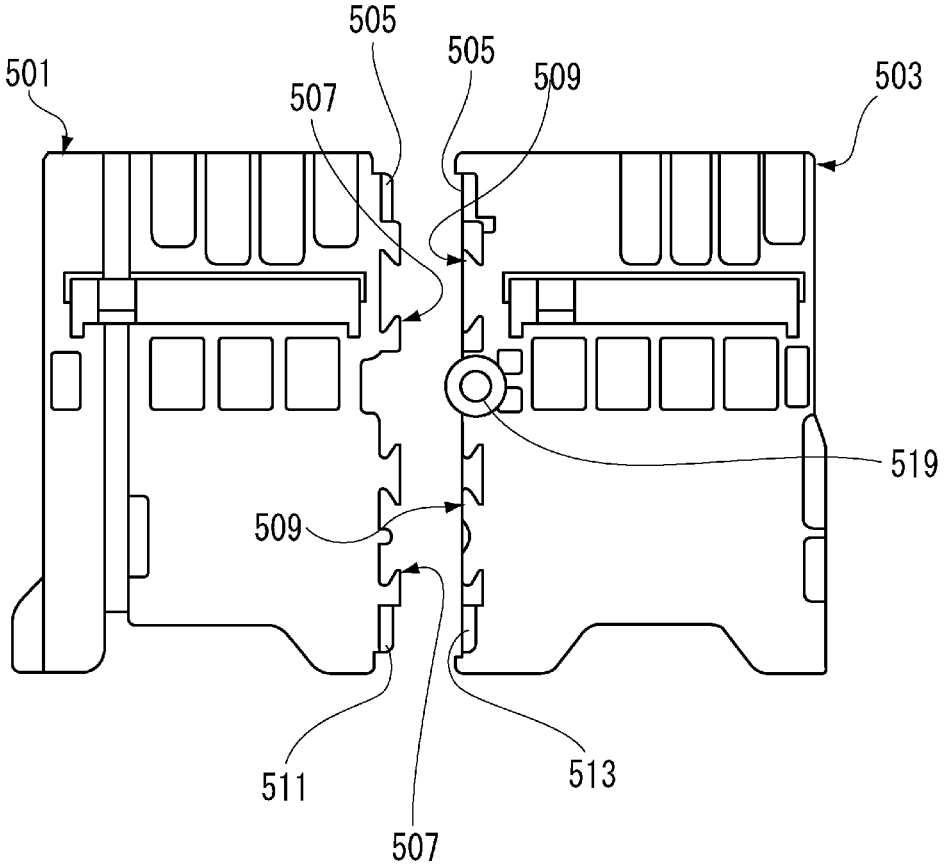
FIG. 15 is an exploded perspective view of a pair of related art housing members.
Figure 16:
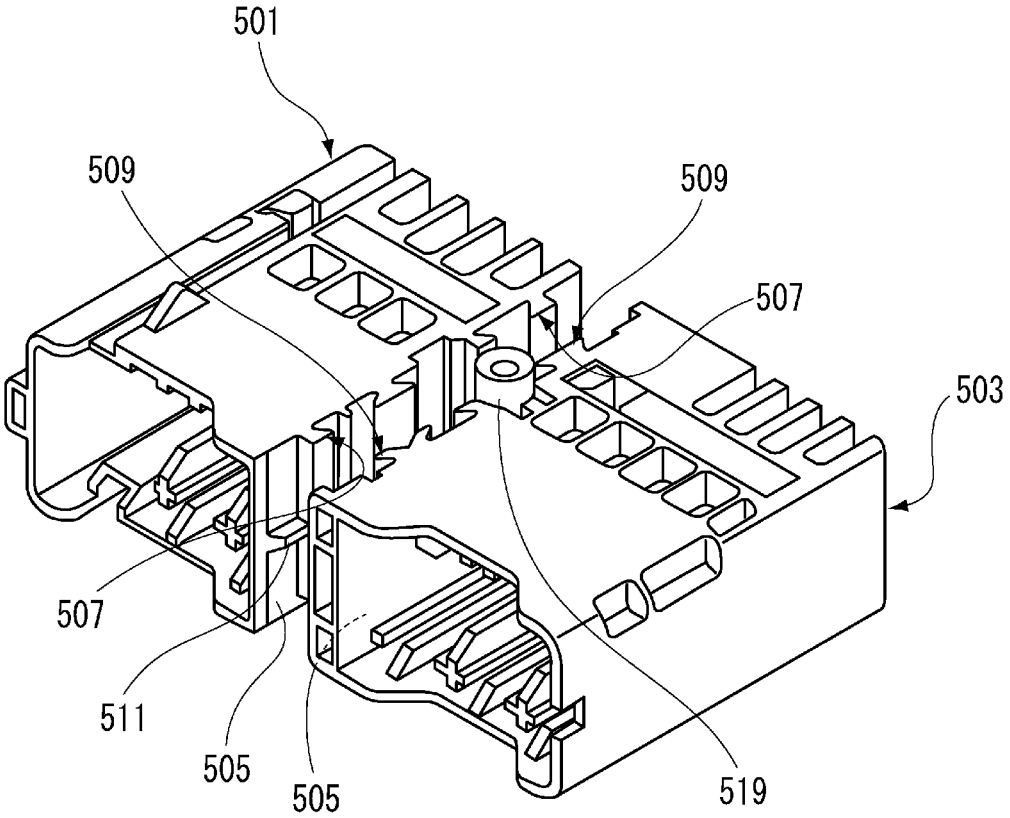
FIG. 16 is an exploded perspective view of the pair of housing members shown in FIG. 15, as seen from one side.
Figure 17:
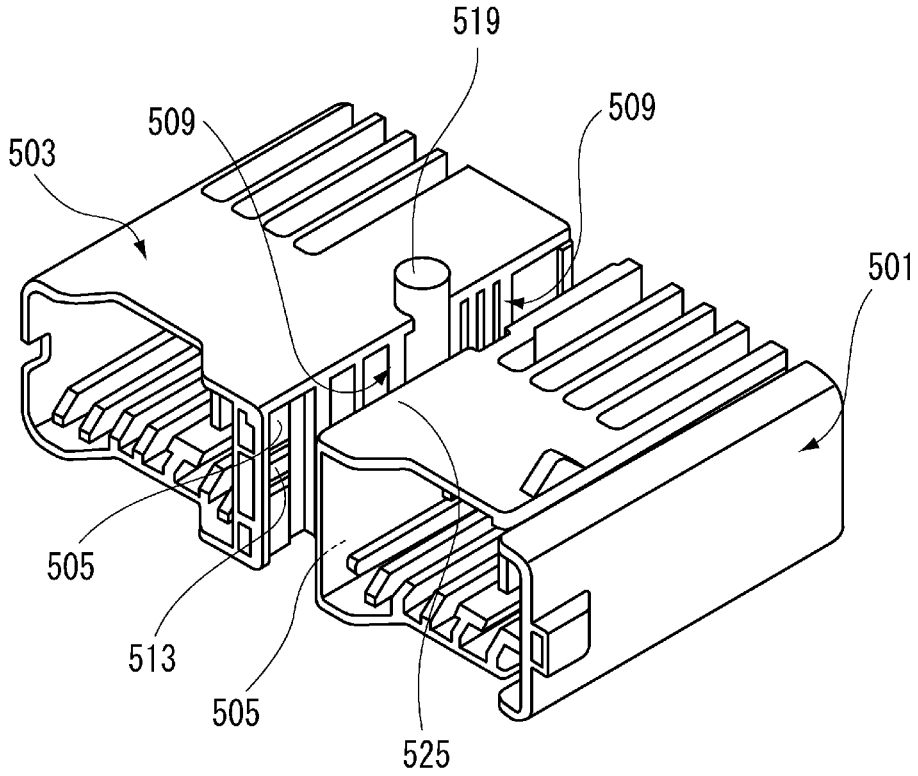
FIG. 17 is an exploded perspective view of the pair of housing members shown in FIG. 15, as seen from the other side.
Figure 18:
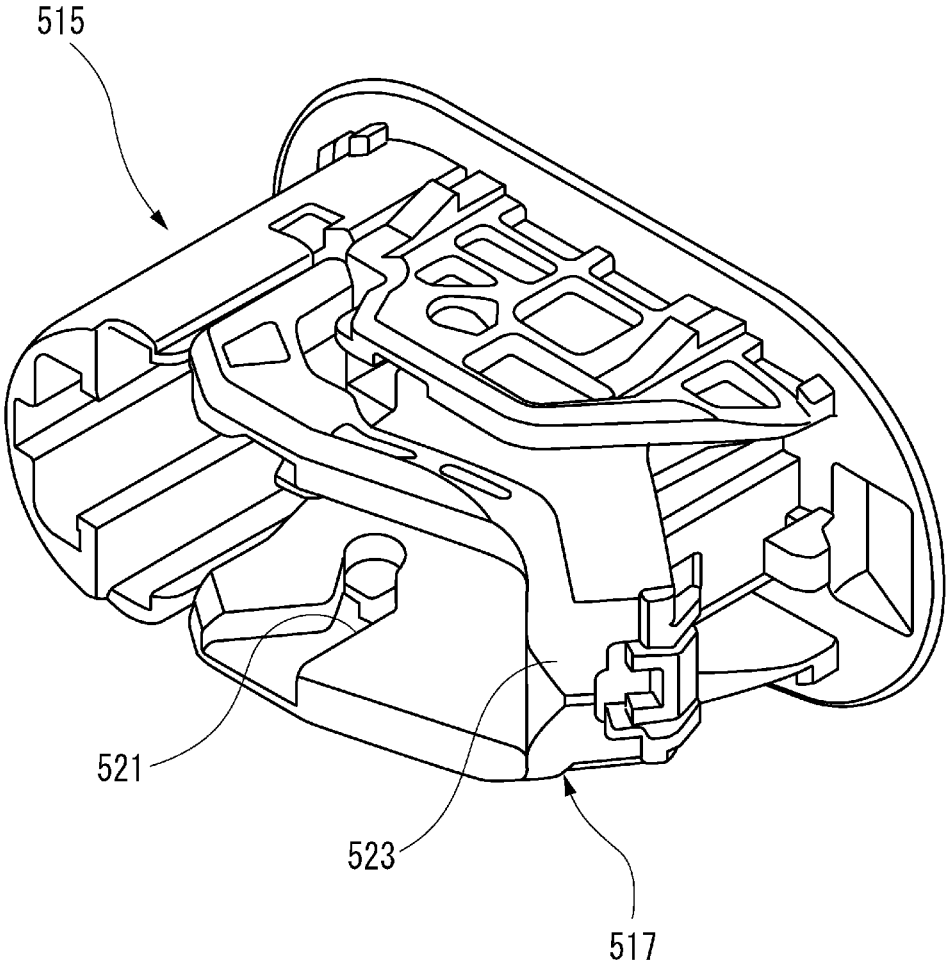
FIG. 18 is a perspective view of a frame in which the pair of housing members shown in FIG. 15 are to be housed.

FIG. 14 is a perspective view of the lever type connector 100 which is attached to the panel 15.

In the lever type connector 100, the panel engagement locks 39 bend toward the inside of the first connector portion 11, engaging claws 89 pass through the mounting hole 17, and thereafter the engaging claws 89 elastically return to engage with the rear side of the edge of the mounting hole 17, thereby completing the attachment to the panel 15.

Next, the function of the above-described configuration will be described.

In the lever type connector 100 of the exemplary embodiment, before the joining, the spacers 69, 81 are attached to the paired housing members 53, 55, respectively. The spacers 69, 81 are attached through the respective one side surfaces 65 of the housing members 53, 55. In the respective one side surfaces 65 of the housing members 53, 55, the mutual insertion of the pair of engaging rails 59, 61 can be performed under visual observation. Moreover, the spacers 69, 81 which are attached to the spacer attachment ports 67, 79, and which are different in color from the housing members 53, 55 are exposed at the same straight line perpendicular to the joining surfaces 57, and therefore they are easy to visually recognize.

On the other side surfaces 71 of the housing members 53, 55, by contrast, the ends of the engaging rails 61 of the housing member 55 are covered by the stopper wall 87. In the pair of housing members 53, 55, therefore, the one engaging rails 61 cannot be observed on the other side surfaces 71. In the lever type connector 100, the exposure holes 73, 83 are formed in the other side surfaces 71. The exposure holes 73, 83 are formed in the other side surfaces 71 of the housing members 53, 55, respectively, and located on the straight line which is perpendicular to the joining surfaces 57.

Through the exposure holes 73, 83, the projections 77, 85 of the spacers 69, 81 which are attached to the housing members 53, 55 are exposed respectively. The projections 77, 85 are different in color from the housing members 53, 55, and therefore are easy to recognize visually. Even in the surfaces where the one engaging rails 61 cannot be observed, therefore, the worker can position the housing members 53, 55 so that the projections 77, 85 which are exposed respectively from the housing members are placed on one straight line, whereby the engaging rails 59, 61 can be easily inserted into each other. In the lever type connector 100, consequently, it is not necessary to turn the two housing members 53, 55 upside down, and the workability of the joining work can be improved.

In the lever type connector 100 of the exemplary embodiment, the projections 77, 85 which are exposed respectively from the housing members 53, 55 are linearly formed.

Therefore, the housing members can be positioned to each other so that the both projections 77, 85 are located on the same straight line. Consequently, the visibility during the positioning work is further improved, and the workability of the joining work is more enhanced.

In the lever type connector 100 of the exemplary embodiment, moreover, the first connector portion 11 and the second connector portion 13 can be set to the properly fitted state by a small insertion force by means of the lever function exerted by the lever 19.

According to the lever type connector 100 of the exemplary embodiment, therefore, the work for joining the pair of housing members 53, 55 together is improved.

While the present invention has been described with reference to certain exemplary embodiments thereof, the scope of the present invention is not limited to the exemplary embodiments described above, and it will be understood by those skilled in the art that various changes and modifications may be made therein without departing from the scope of the present invention as defined by the appended claims.

Illustrative aspects of the exemplary embodiments described above will be described below.

A connector (e.g., the lever type connector 100) includes a first connector portion (11), a second connector portion (13) having at least a first housing member (53) and a second housing member (55) that are configured to be fitted to the first connector portion (11) in a state in which the first housing member (53) and the second housing member (55) joined to each other, a first spacer (69) configured to be inserted into the first housing member (53) from a side surface (65) of the first housing member (53) to restrict a first terminal housed inside the first housing member (53) from being pulled out, and a second spacer (81) configured to be inserted into the second housing member (55) from a side surface (65) of the second housing member (55) to restrict a second terminal housed inside the second housing member (53) from being pulled out. The first housing member (53) includes a first joining surface (57) to which the second housing member (55) is joined and a first engaging rail (59) formed on the first joining surface (57). The second housing member (55) includes a second joining surface (57) to which the first housing member (53) is joined and a second engaging rail (61) formed on the second joining surface (57). The first engaging rail (59) and the second engaging rail (61) are configured restrict a relative movement of the first housing member (53) and the second housing member (55) in a direction away from each other when the first housing member (53) and the second housing member (55) are joined to each other with the first engaging rail (59) and the second engaging rail (61) being engaged with each other. The first engaging rail (59) and the second engaging rail (61) are configured to be insertable to each other, along a longitudinal direction of the first engaging rail (59) and the second engaging rail (61), from an end of the first engaging rail (59) on one side and from an end of the second engaging rail (61) on another side to engage the first engaging rail (59) and the second engaging rail (61) with each other. The first housing member (53) has a first exposure hole (73) on another side surface (71) of the first housing member (53). The second housing member (55) has a second exposure hole (83) on another side surface (71) of the second housing member (55). The first exposure hole (73) and the second exposure hole (83) are located on a straight line perpendicular to the first joining surface (57) and the second joining surface (57) in the state in which the first housing member (53) and the second housing member (55) joined to each other. The first spacer (69) is different in color from the first housing member (53) and has a first projection (77) to be exposed from the first exposure hole (73) on the other side surface (71) of the first housing member (53) when the first spacer (69) is attached to the first housing member (53). The second spacer (81) is different in color from the second housing member (55) and has a second projection (85) to be exposed from the second exposure hole (83) on the other side surface (71) of the second housing member (55) when the second spacer (81) is attached to the second housing member (55).

The first projection (77) and the second projection (85) may be linearly formed in a direction along the straight line perpendicular to the first joining surface (57) and the second joining surface (57).

The connector may be a lever type connector (100) including a lever (19) provide inside the first connector portion (11) and configured to rotate to causes the first connector portion (11) and the second connector portion (13) to be fitted to each other.

What is claimed is:

1. A connector comprising:

a first connector portion;

a second connector portion comprising at least a first housing member and a second housing member that are configured to be fitted to the first connector portion in a state in which the first housing member and the second housing member joined to each other;

a first spacer configured to be inserted into the first housing member from a side surface of the first housing member to restrict a first terminal housed inside the first housing member from being pulled out; and a second spacer configured to be inserted into the second housing member from a side surface of the second housing member to restrict a second terminal housed inside the second housing member from being pulled out, wherein the first housing member comprises a first joining surface to which the second housing member is joined and a first engaging rail formed on the first joining surface, wherein the second housing member comprises a second joining surface to which the first housing member is joined and a second engaging rail formed on the second joining surface, wherein the first engaging rail and the second engaging rail are configured restrict a relative movement of the first housing member and the second housing member in a direction away from each other when the first housing member and the second housing member are joined to each other with the first engaging rail and the second engaging rail being engaged with each other, the first engaging rail and the second engaging rail are configured to be insertable to each other, along a longitudinal direction of the first engaging rail and the second engaging rail, from an end of the first engaging rail on one side and from an end of the second engaging rail on another side to engage the first engaging rail and the second engaging rail with each other, wherein the first housing member has a first exposure hole on another side surface of the first housing member, wherein the second housing member has a second exposure hole on another side surface of the second housing member, wherein the first exposure hole and the second exposure hole are located on a straight line perpendicular to the first joining surface and the second joining surface in the state in which the first housing member and the second housing member joined to each other, wherein the first spacer is different in color from the first housing member and has a first projection to be exposed from the first exposure hole on the other side surface of the first housing member when the first spacer is attached to the first housing member, and wherein the second spacer is different in color from the second housing member and has a second projection to be exposed from the second exposure hole on the other side surface of the second housing member when the second spacer is attached to the second housing member.

2. The connector according to claim 1, wherein the first projection and the second projection are linearly formed in a direction along the straight line perpendicular to the first joining surface and the second joining surface.

3. The connector according to claim 1, wherein the connector is a lever type connector including a lever provide inside the first connector portion and configured to rotate to causes the first connector portion and the second connector portion to be fitted to each other.

* * * * *